US009187287B2

(12) United States Patent
Kikuchi et al.

(10) Patent No.: US 9,187,287 B2
(45) Date of Patent: Nov. 17, 2015

(54) SHEET PROCESSING APPARATUS AND IMAGE PROCESSING SYSTEM

(71) Applicants: Atsushi Kikuchi, Kanagawa (JP); Kiyoshi Hata, Tokyo (JP); Keisuke Sugiyama, Tokyo (JP); Tomomichi Hoshino, Kanagawa (JP); Mamoru Kambayashi, Tokyo (JP); Makoto Hidaka, Tokyo (JP); Satoshi Saito, Kanagawa (JP); Shohichi Satoh, Kanagawa (JP)

(72) Inventors: Atsushi Kikuchi, Kanagawa (JP); Kiyoshi Hata, Tokyo (JP); Keisuke Sugiyama, Tokyo (JP); Tomomichi Hoshino, Kanagawa (JP); Mamoru Kambayashi, Tokyo (JP); Makoto Hidaka, Tokyo (JP); Satoshi Saito, Kanagawa (JP); Shohichi Satoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/140,706

(22) Filed: Dec. 26, 2013

(65) Prior Publication Data

US 2014/0187407 A1 Jul. 3, 2014

(30) Foreign Application Priority Data

Dec. 28, 2012 (JP) ..... 2012-288831

(51) Int. Cl.

| | |
|---|---|
| ***B65H 45/18*** | (2006.01) |
| ***B31F 1/00*** | (2006.01) |
| ***B65H 45/12*** | (2006.01) |
| ***B65H 45/04*** | (2006.01) |

(52) U.S. Cl.

CPC *B65H 45/18* (2013.01); *B31F 1/00* (2013.01); *B31F 1/0006* (2013.01); *B31F 1/0035* (2013.01); *B65H 45/04* (2013.01); *B65H 45/12* (2013.01); *B65H 2301/51232* (2013.01); *B65H 2701/13212* (2013.01); *B65H 2801/27* (2013.01)

(58) Field of Classification Search

CPC ..... B31F 1/00; B31F 1/0006; B31F 1/0035; B65H 45/12; B65H 45/04; B65H 2801/27

USPC ..... 270/32, 45, 58.07

See application file for complete search history.

(56) References Cited

U.S. PATENT DOCUMENTS

| | | | | |
|---|---|---|---|---|
| 6,817,605 | B1 * | 11/2004 | Bohn | 270/37 |
| 6,905,118 | B2 * | 6/2005 | Yamada et al. | 270/8 |
| 7,285,084 | B2 * | 10/2007 | Fujimoto et al. | 493/442 |
| 7,431,274 | B2 | 10/2008 | Kushida et al. | |
| 7,673,862 | B2 | 3/2010 | Kushida et al. | |
| 7,922,162 | B2 * | 4/2011 | Kamiya | 270/45 |

(Continued)

FOREIGN PATENT DOCUMENTS

| | | |
|---|---|---|
| JP | 2003-341930 | 12/2003 |
| JP | 2004-059304 A | 2/2004 |

(Continued)

OTHER PUBLICATIONS

Office Action for corresponding Japanese application No. 2012-288831 dated Sep. 29, 2015.

*Primary Examiner* — Leslie A Nicholson, III

(74) *Attorney, Agent, or Firm* — Harness, Dickey & Pierce, P.L.C.

(57) ABSTRACT

The present invention is concerning to a sheet processing apparatus comprising: a pressing member configured to press a folding line portion of a sheet bundle being folded; and a moving unit configured to move the pressing member to a folding line direction of the sheet bundle, wherein the pressing member pressurizes a part of the sheet bundle corresponding to a downstream side of a conveyance direction of the sheet bundle.

15 Claims, 14 Drawing Sheets

(56) References Cited

U.S. PATENT DOCUMENTS

| | | | | |
|---|---|---|---|---|
| 7,950,641 | B2 * | 5/2011 | Kikkawa et al. | 270/32 |
| 8,201,815 | B2 * | 6/2012 | Sasahara et al. | 270/45 |
| 8,317,181 | B2 | 11/2012 | Suzuki | |
| 2003/0151187 | A1 | 8/2003 | Suzuki et al. | |
| 2003/0160376 | A1 | 8/2003 | Yamada et al. | |
| 2003/0215275 | A1 | 11/2003 | Tamura et al. | |
| 2003/0219295 | A1 | 11/2003 | Saitoh et al. | |
| 2003/0234487 | A1 | 12/2003 | Tamura et al. | |
| 2004/0070133 | A1 | 4/2004 | Yamada et al. | |
| 2004/0104525 | A1 | 6/2004 | Suzuki et al. | |
| 2012/0231942 | A1 | 9/2012 | Sasahara et al. | |

FOREIGN PATENT DOCUMENTS

| | | | |
|---|---|---|---|
| JP | 2005-239414 | A | 9/2005 |
| JP | 2010-116266 | A | 5/2010 |
| JP | 2012-081625 | A | 4/2012 |

* cited by examiner

SHEET PROCESSING APPARATUS AND IMAGE PROCESSING SYSTEM

CROSS-REFERENCE TO RELATED APPLICATIONS

The present application claims priority to and incorporates by reference the entire contents of Japanese Patent Application No. 2012-288831 filed in Japan on Dec. 28, 2012.

BACKGROUND OF THE INVENTION

1. Field of the Invention

The present invention relates to a sheet processing apparatus and an image processing system, more particularly to an additional folding process mechanism which reinforces a folding line of a center-folded sheet bundle formed of a sheet of paper or the like.

2. Description of the Related Art

A sheet such as a sheet of paper printed out by an image forming apparatus such as a copying machine, a printer, or a printing machine is discharged from the image forming apparatus in one case and, in another case, made into a booklet by a center folding process in which a center part of a predetermined number of sheets being put together is stitched and folded inside.

On the other hand, in order to reinforce the folding line at a center-folded part of the booklet formed of a saddle-stitched sheet bundle, there is known an additional folding work in which a roller moving along the back of the booklet is pressed against the folding line portion.

It is known that the additional folding work is configured to press the roller against the folding line portion while moving the roller parallel to a folding line direction, the roller having a shaft direction perpendicular to the folding line of the booklet.

Having been folded in, however, the folding line portion of the booklet is bulged out by a shape restoration force generated at the time the booklet is pressurized and folded up by the roller. The bulged-out portion is thus pressurized by an edge of the roller that is in contact with a sheet end side from a stitch position, namely, the folded booklet corresponding to an upstream side of a conveyance direction, in a direction perpendicular to the folding line direction. This kind of work sometimes causes damage such as a pressurized mark left in a pressurized part.

There has been proposed a configuration, as a configuration that reduces such damage, in which the direction of the roller pressurizing the folding line portion is tilted with respect to the folding line direction (refer to Japanese Laid-Open Patent Application Publication No. 2003-341930, for example).

This configuration gets rid of the bulged-out portion and avoids leaving the pressurized mark by stretching the bulged-out portion while using a component of force that is obtained from a tilt angle and works in a direction to generate tension on the sheet of paper at the time the roller adds pressure while moving along the folding line or what is called a back of the booklet.

The configuration disclosed in Japanese Laid-Open Patent Application Publication No. 2003-341930 can get rid of the bulge at the stitch position of the sheet of paper, but a shaft line of the roller is sometimes tilted due to processing accuracy or assembling accuracy of a mechanism used to add the pressurizing force.

In this case, the shaft line is tilted not in the aforementioned folding line direction but tilted relative to the surface of the booklet, specifically in a vertical direction relative to the surface.

This kind of tilt causes an edge of the roller in a width direction to be strongly pressed against a part of the sheet, thereby sometimes leaving the pressurized mark in the pressed part. Therefore, as it stands, the damage such as the pressurized mark done to the sheet cannot be completely eliminated even when the roller is tilted with respect to the folding line direction.

Considering the problem in the aforementioned sheet processing apparatus in the related art, there is need to provide a sheet processing apparatus and an image forming system including a configuration that can completely eliminate the damage such as the pressurized mark in pressurizing the center-folded part of the sheet.

SUMMARY OF THE INVENTION

It is an object of the present invention to at least partially solve the problems in the conventional technology.

According to the present invention, there is provided: a sheet processing apparatus comprising: a pressing member configured to press a folding line portion of a sheet bundle being folded; and a moving unit configured to move the pressing member to a folding line direction of the sheet bundle, wherein the pressing member pressurizes a part of the sheet bundle corresponding to a downstream side of a conveyance direction of the sheet bundle.

The present invention also provides an image processing system comprising an image forming apparatus and a sheet processing apparatus that saddle-stitches a sheet bundle and center-folds the sheet bundle, wherein the image forming apparatus is used as a preceding apparatus and the sheet processing apparatus is used as a following apparatus, and the image forming apparatus is connected to the sheet processing apparatus at a boundary corresponding to a position at which the sheet bundle is subjected to saddle stitching and center folding.

In the above-defined image processing system, the sheet processing apparatus comprises; a pressing member configured to press a folding line portion of the sheet bundle, and a moving unit configured to move the pressing member to a folding line direction of the sheet bundle, wherein the pressing member pressurizes a part of the sheet bundle corresponding to a downstream side of a conveyance direction of the sheet bundle.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
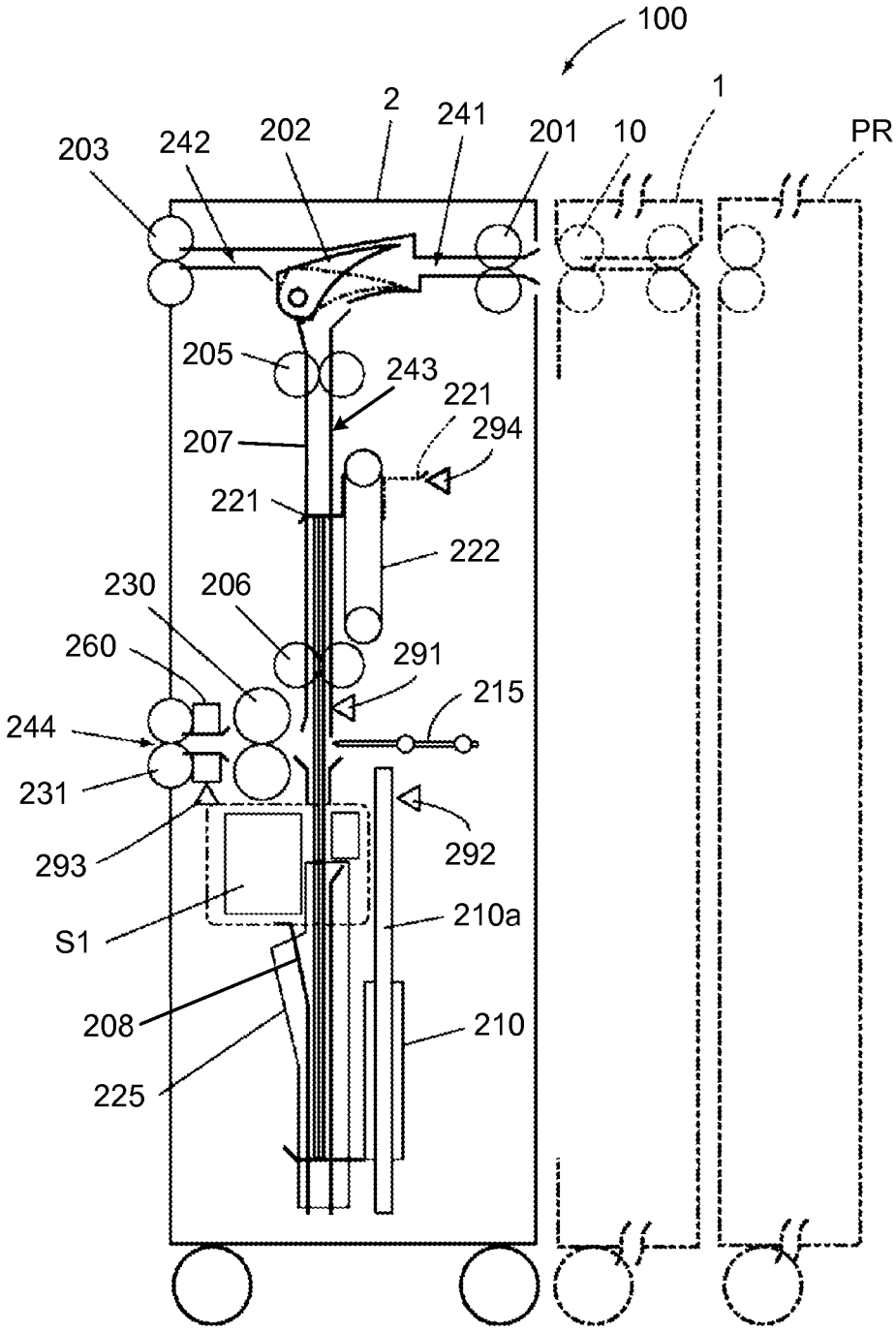
FIG. 1 is a diagram illustrating a system configuration of an image processing system including an image forming apparatus and a plurality of sheet processing apparatuses according to an embodiment of the present invention.

Modes of carrying out the present invention will now be described on the basis of embodiments illustrated in the drawings.

A configuration and an operation of a sheet processing apparatus according to the present invention will be described first before describing a characteristic of an embodiment of the present invention.

FIG. 1 is a diagram illustrating a system configuration of an image processing system 100 including an image forming apparatus and a plurality of sheet processing apparatuses according to the present embodiment. In the present embodiment, an image forming apparatus PR is installed as an apparatus preceding first and second sheet processing apparatuses 1 and 2, and the first and second sheet processing apparatuses 1 and 2 are connected in this order as apparatuses in the following stage.

The first sheet processing apparatus 1 is a sheet post-processing apparatus having a sheet bundle generating function which receives one sheet at a time from the image forming apparatus PR, stacks and aligns the sheet in succession, and generates a sheet bundle by a stack unit. The sheet bundle is discharged from a sheet bundle discharge roller 10 of the first sheet processing apparatus 1 to the second sheet processing apparatus 2 in the following stage.

The second sheet processing apparatus 2 is a saddle stitch book binding device which receives the sheet bundle being conveyed to perform saddle stitching/center folding (the second sheet processing apparatus described herein is also referred to as the saddle stitch book binding device).

The saddle stitch book binding device 2 discharges a bound booklet (sheet bundle) as is or to a sheet processing apparatus in the following stage. The image forming apparatus PR forms a visible image on a sheet-like recording medium on the basis of image data being input or image data of an image being read. The image forming apparatus corresponds to a copying machine, a printer, a facsimile machine, or a digital multifunction peripheral including at least two of the functions of these machines, for example. The image forming apparatus PR may employ any known image forming method such as an electrophotographic system or a liquid droplet ejection system.

The saddle stitch book binding device 2 illustrated in FIG. 1 includes an inlet conveyance path 241, a sheet-through conveyance path 242, and a center folding conveyance path 243. Provided at an uppermost stream part of the inlet conveyance path 241 in a sheet conveyance direction is an inlet roller 201 through which the aligned sheet bundle is conveyed into the apparatus from the sheet bundle discharge roller 10 of the first sheet processing apparatus 1. Note that in the description below, an upstream side of the sheet conveyance direction and a downstream side of the sheet conveyance direction are simply referred to as an upstream side and a downstream side, respectively.

A bifurcating claw 202 is provided on the downstream side of the inlet roller 201 of the inlet conveyance path 241.

The bifurcating claw 202 installed in a horizontal direction in FIG. 1 bifurcates the conveyance direction of the sheet bundle into the sheet-through conveyance path 242 or the center folding conveyance path 243.

The sheet-through conveyance path 242 extending horizontally from the inlet conveyance path 241 is a conveyance path that guides the sheet bundle to a processing apparatus (not illustrated) in the following stage or to a paper discharge tray, and the sheet bundle is discharged to the following stage by an upper paper discharge roller 203.

The center folding conveyance path 243 extending perpendicularly below the bifurcating claw 202 is a conveyance path that performs a saddle stitching/center folding process on the sheet bundle.

The center folding conveyance path 243 includes an upper bundle conveyance guide board 207 which guides the sheet bundle in a part above a folding plate 215 performing center-folding and a lower bundle conveyance guide board 208 which guides the sheet bundle within a part below the folding plate 215.

The upper bundle conveyance guide board 207 is provided with, from the upper part, an upper bundle conveyance roller 205, a rear end hitting claw 221, and a lower bundle conveyance roller 206. The rear end hitting claw 221 is erected against a rear end hitting claw drive belt 222 which is driven by a drive motor not illustrated. The rear end hitting claw 221 hits (presses) a rear end of the sheet bundle to the side of a movable fence, to be described, by the reciprocating rotational motion of the rear end hitting claw drive belt 222 and thus performs an alignment operation of the sheet bundle. Moreover, the rear end hitting claw retreats from the center folding conveyance path 243 of the upper bundle conveyance guide board 207 (to a position indicated by a dotted line in FIG. 1) when the sheet bundle is brought in or raised for center folding.

A reference numeral 294 is a rear end hitting claw HP sensor which detects a home position of the rear end hitting claw 221, and detects the position indicated by the dotted line in FIG. 1 (a position indicated by a solid line in FIG. 2) as the home position of the rear end hitting claw retreated from the center folding conveyance path 243. The rear end hitting claw 221 is controlled on the basis of this home position.

The lower bundle conveyance guide board 208 is provided with, from the upper part, a saddle stitching stapler S1, a saddle stitching jogger fence 225, and a movable fence 210. The lower bundle conveyance guide board 208 is a guide board that receives the sheet bundle conveyed through the upper bundle conveyance guide board 207, and is provided with a pair of the saddle stitching jogger fences 225 installed in a width direction. Provided below the saddle stitching jogger fence 225 is the movable fence 210 that can move up and down while abutting on (supporting) an edge of the sheet bundle.

The saddle stitching stapler S1 stitches a center part of the sheet bundle. The movable fence 210 can move in a vertical direction while supporting the edge of the sheet bundle. Accordingly, a stapling process, namely the saddle stitching, is performed at a central position of the sheet bundle when the central position is moved to a position facing the saddle stitching stapler S1.

The movable fence 210 is supported by a movable fence drive mechanism 210*a* and can move from the position of a movable fence HP sensor 292 illustrated in the upper part down to the lowermost position. The movable range of the movable fence 210 abutting on the edge of the sheet bundle ensures a stroke covering the maximum size to the minimum size the saddle stitch book binding device 2 can process. Note that a rack and pinion mechanism is employed as the movable fence drive mechanism 210*a*, for example.

Provided between the upper and lower bundle conveyance guide boards 207 and 208, namely, at a roughly center part of the center folding conveyance path 243, are the folding plate 215, a folding roller pair 230, an additional folding roller unit 260, and a lower paper discharge roller 231.

The additional folding roller unit 260 is used to reinforce the folding line portion by pressurizing the folding line portion of the sheet bundle again, where an additional folding roller is disposed above and below a paper discharge conveyance path that is provided between the folding roller pair 230 and the lower paper discharge roller 231.

The folding plate 215 can move back and forth in the horizontal direction in the figure, and a nip of the folding roller pair 230 is located in a direction into which the folding operation is performed. A paper discharge conveyance path 244 is installed at a position along the extension of the nip. The lower paper discharge roller 231 is provided at the lowermost stream of the paper discharge conveyance path 244 and discharges the folded sheet bundle to the following stage.

A sheet bundle detection sensor 291 is provided at the lower end side of the upper bundle conveyance guide board 207 to detect the edge of the sheet bundle that is brought into the center folding conveyance path 243 and passes through the center fold position. Moreover, the paper discharge conveyance path 244 is provided with a fold passing sensor 293 which detects the edge of the center-folded sheet bundle and recognizes the sheet bundle passing through.

Generally, the saddle stitch book binding device 2 configured as illustrated in FIG. 1 performs the saddle stitching/center folding operation as illustrated in each of FIGS. 2 to 6 illustrating the operation. That is, when the saddle stitching/center folding operation is selected by an operation panel (not illustrated) of the image forming apparatus PR, the sheet bundle selected to undergo the saddle stitching/center folding operation is guided to the side of the center folding conveyance path 243 by a displacement motion of the bifurcating claw 202 in a counterclockwise direction. Note that the bifurcating claw 202 is driven by a solenoid but may also be driven by a motor instead.

A sheet bundle SB brought into the center folding conveyance path 243 is conveyed downward through the center folding conveyance path 243 by the inlet roller 201 and the upper bundle conveyance roller 205, while the sheet bundle detection sensor 291 detects a passing state of the sheet bundle.

Figure 2:
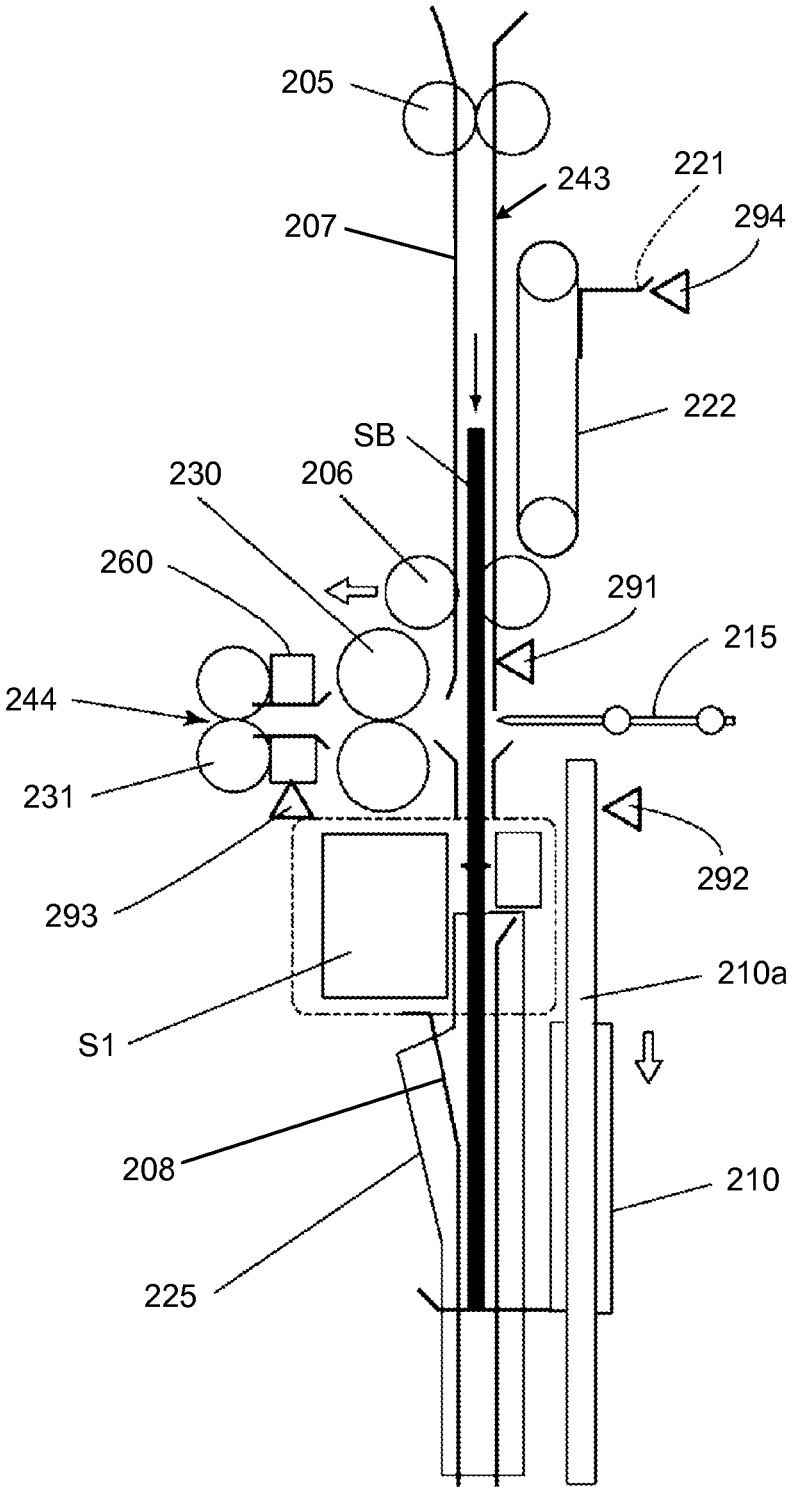
FIG. 2 is a diagram illustrating an operation of a saddle stitch book binding device where a sheet bundle is brought into a center folding conveyance path.

Once the passing of the sheet bundle SB is confirmed, the sheet bundle is conveyed by the lower bundle conveyance roller 206 to the position at which the edge of the sheet bundle SB abuts on the movable fence 210, as illustrated in FIG. 2. At this time, the movable fence 210 stands by at a different stop position according to sheet size information from the image forming apparatus PR or, in this case, size information of each sheet bundle SB in the conveyance direction. FIG. 2 illustrates a state where the sheet bundle SB is nipped by the nip of the lower bundle conveyance roller 206 while the rear end hitting claw 221 stands by at the home position.

Figure 3:
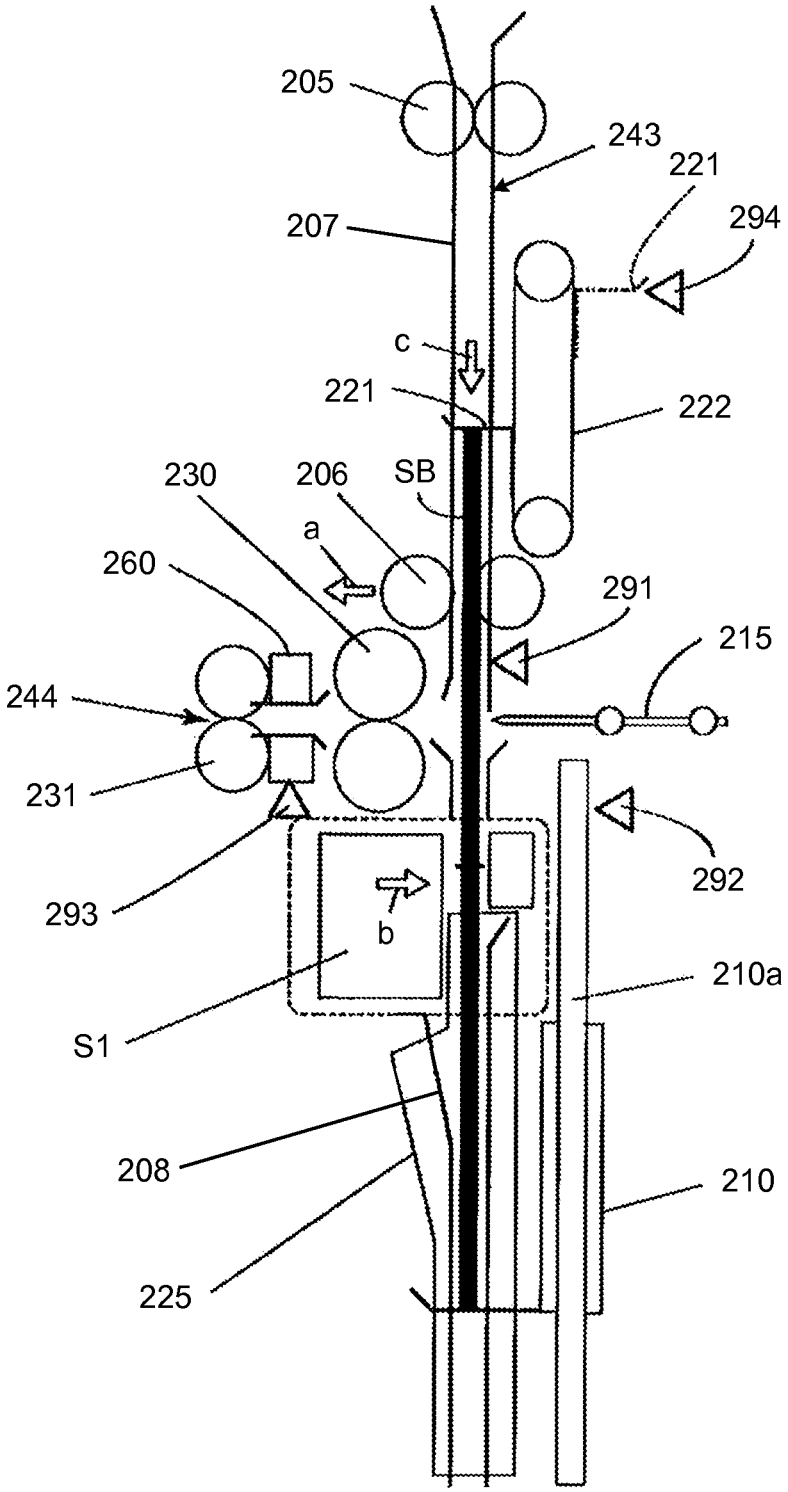
FIG. 3 is a diagram illustrating a state where the sheet bundle is saddle stitched by the saddle stitch book binding device.

The nip pressure by the lower bundle conveyance roller 206 is released (in a direction indicated by an arrowed line "a") in this state as illustrated in FIG. 3. Following this operation, the edge of the sheet bundle abuts on the movable fence 210 so that the sheet bundle is stacked with a free rear end, at which time the rear end hitting claw 221 is driven and performs the final alignment in the conveyance direction (in a direction indicated by an arrow "c") by hitting the rear end of the sheet bundle SB.

Subsequently, an alignment operation in the width direction (a direction orthogonal to the sheet conveyance direction) is completed by the saddle stitching jogger fence 225. Each of the movable fence 210 and the rear end hitting claw 221 performs an alignment operation in the conveyance direction, whereby the alignment operation of the sheet bundle SB in both the width direction and the conveyance direction is completed.

Here, the alignment is performed while changing the amount to be pushed in by the rear end hitting claw 221 and the saddle stitching jogger fence 225 to an optimal value according to the sheet size information, number of sheets information of the sheet bundle, and sheet bundle thickness information.

It is often the case that the sheet bundle cannot be aligned completely in one alignment operation when the sheet bundle is thick because a space in the conveyance path is decreased.

The number of alignments is increased in such case, thereby realizing a better alignment state. Moreover, it takes more time to stack the sheet successively on the upstream side as the number of sheets increases, whereby more time is required before a next sheet bundle SB can be accepted. As a result, the satisfactory alignment state can be realized efficiently because there is no time loss as a system when the number of alignments is increased. It is therefore possible to control the number of alignments in accordance with the processing time required on the upstream side.

Note that the stand-by position of the movable fence 210 is normally set at a position where the saddle stitch position of the sheet bundle SB faces the stitch position of the saddle stitching stapler S1. This allows the sheet bundle to undergo the stitching process where it is stacked without moving the movable fence 210 to the saddle stitch position of the sheet bundle SB. Now, at the stand-by position, a stitcher of the saddle stitching stapler S1 is driven in a direction indicated by an arrowed line "b" to the center part of the sheet bundle SB and performs the stitching process with a clincher, thereby saddle stitching the sheet bundle SB.

The positioning of the movable fence 210 is performed by pulse control from the movable fence HP sensor 292, while the positioning of the rear end hitting claw 221 is performed by pulse control from the rear end hitting claw HP sensor 294. The positioning control for the movable fence 210 and the rear end hitting claw 221 is executed by a CPU of a control circuit (not illustrated) of the saddle stitch book binding device 2.

Figure 4:
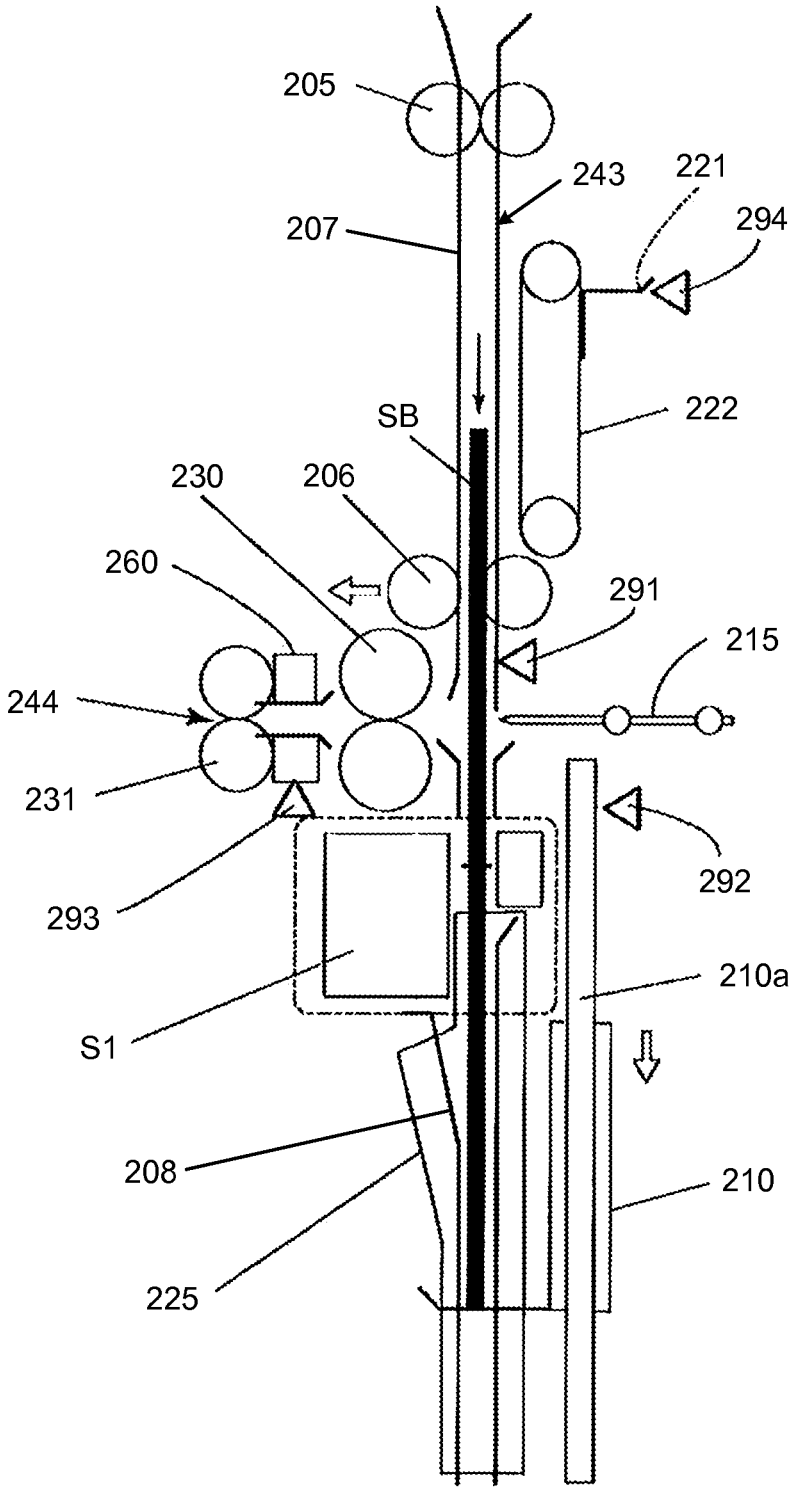
FIG. 4 is a diagram illustrating a state where transferring of the sheet bundle to a center fold position is completed by the saddle stitch book binding device.

The sheet bundle SB that is saddle stitched as illustrated in FIG. 3 is now transported to a position at which the saddle stitch position (the center position of the sheet bundle SB in the conveyance direction) faces the folding plate 215 along the upward movement of the movable fence 210 while the pressurization by the lower bundle conveyance roller 206 is released, as illustrated in FIG. 4. This position as well is controlled on the basis of a position detected by the movable fence HP sensor 292. The folding plate 215 is a member that exerts a function to be described as a folding unit that folds in the sheet bundle.

Figure 5:
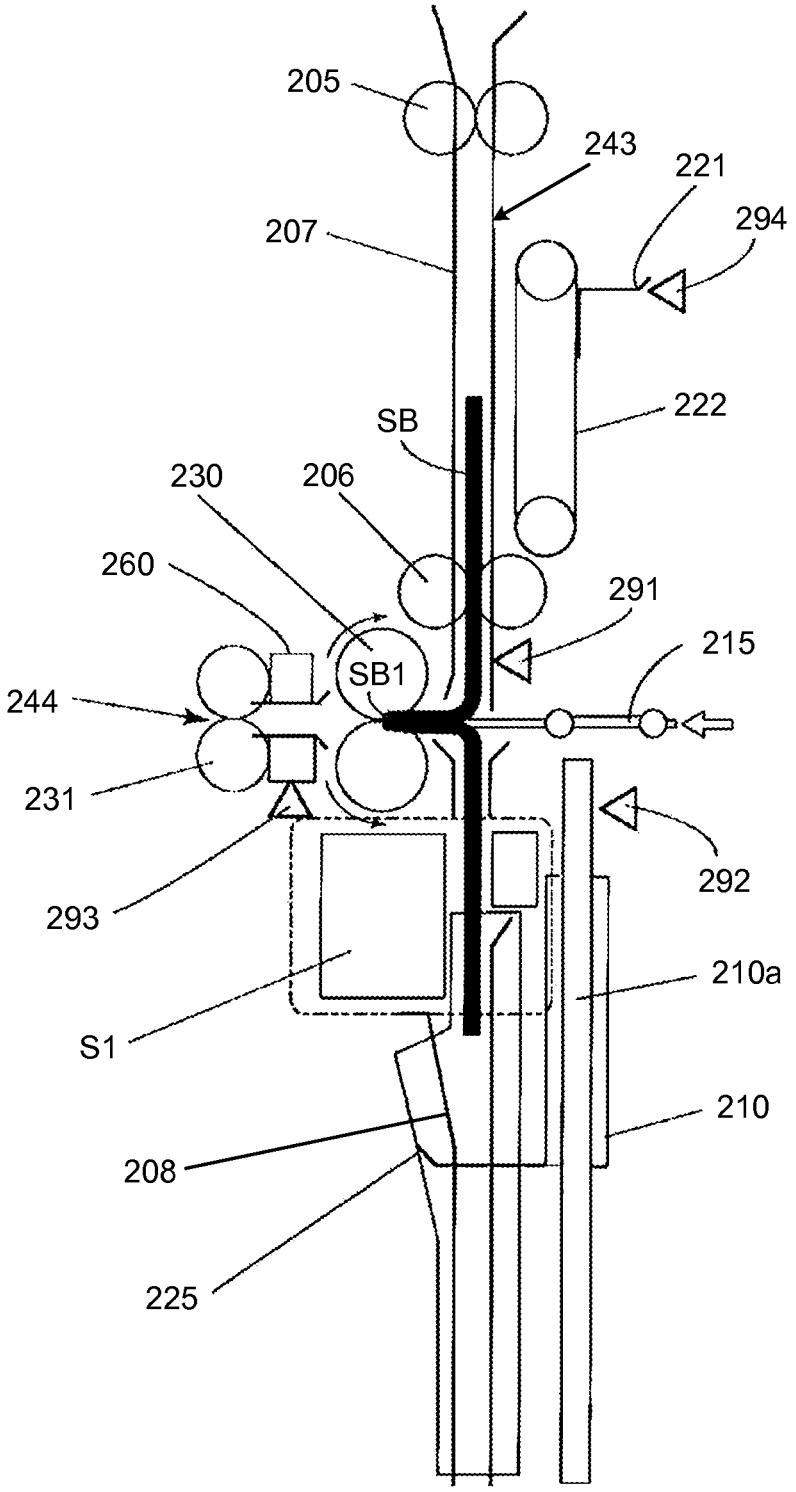
FIG. 5 is a diagram illustrating a state where a center folding process is performed on the sheet bundle by the saddle stitch book binding device.

Once the sheet bundle SB reaches the position illustrated in FIG. 4, the folding plate 215 is moved toward the nip of the folding roller pair 230, abuts on the sheet bundle SB, from a direction roughly perpendicular to the sheet bundle, in the vicinity of a needle portion at which the sheet bundle SB is stitched, and then pushes out the sheet bundle to the side of the nip. Pushed by the folding plate 215, the sheet bundle SB is guided to the nip of the folding roller pair 230 and pushed into the nip of the folding roller pair 230 that has been rotating. The folding roller pair 230 pressurizes and conveys the sheet bundle SB being pushed into the nip. The sheet bundle SB is folded at the center by this pressurization/conveyance operation, whereby a simply bound sheet bundle SB is formed. FIG. 5 illustrates a state where the edge of a folding line portion SB1 of the sheet bundle SB is nipped and pressurized by the nip of the folding roller pair 230.

Figure 6:
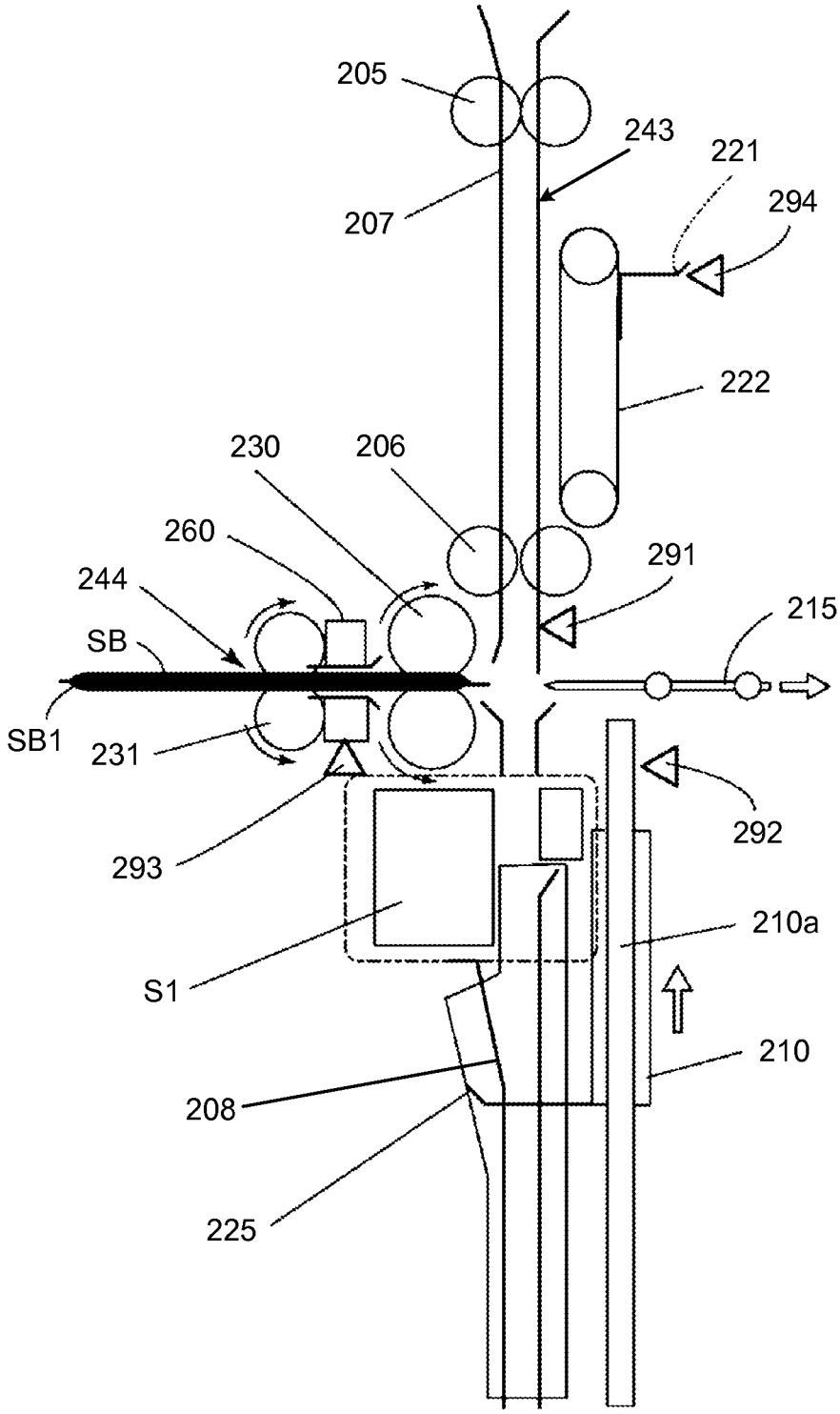
FIG. 6 is a diagram illustrating a state where the center-folded sheet bundle is discharged by the saddle stitch book binding device.

The sheet bundle SB folded in half at the center as illustrated in FIG. 5 is conveyed, as the sheet bundle SB, by the folding roller pair 230 and discharged to the following stage while nipped by the lower paper discharge roller 231, as illustrated in FIG. 6. When the rear end of the sheet bundle SB is detected by the fold passing sensor 293, the folding plate 215 and the movable fence 210 return to the home position and the lower bundle conveyance roller 206 to the pressurizing state, and prepare for the next sheet bundle SB to be brought in. The movable fence 210 may be moved to the position illustrated in FIG. 2 again and stand by when a next job has the same size and number of sheets. Note that these controls are also executed by the CPU of the control circuit.

Figure 7:
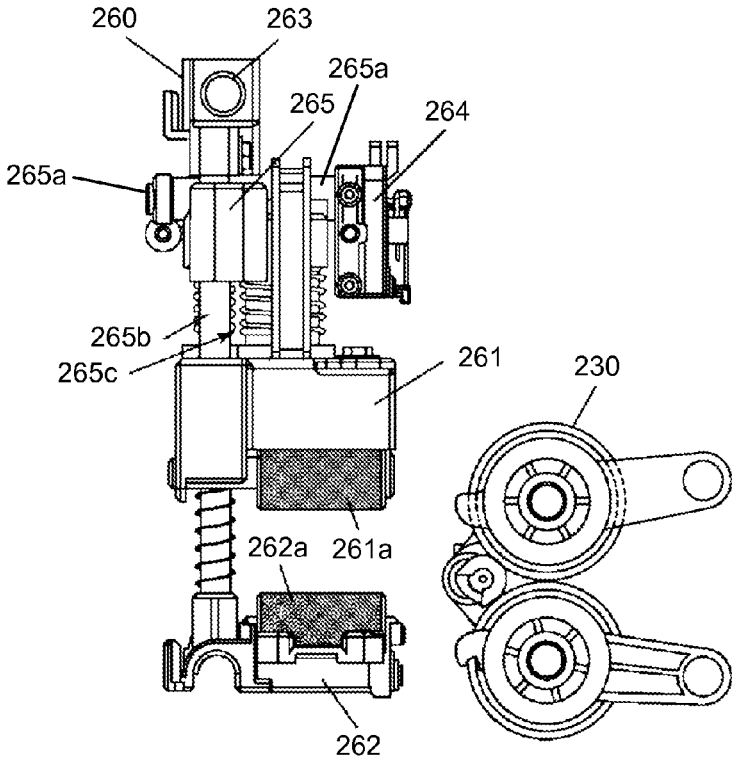
FIG. 7 is a set of front views illustrating a principal part of an additional folding roller unit and a folding roller pair.
Figure 8:
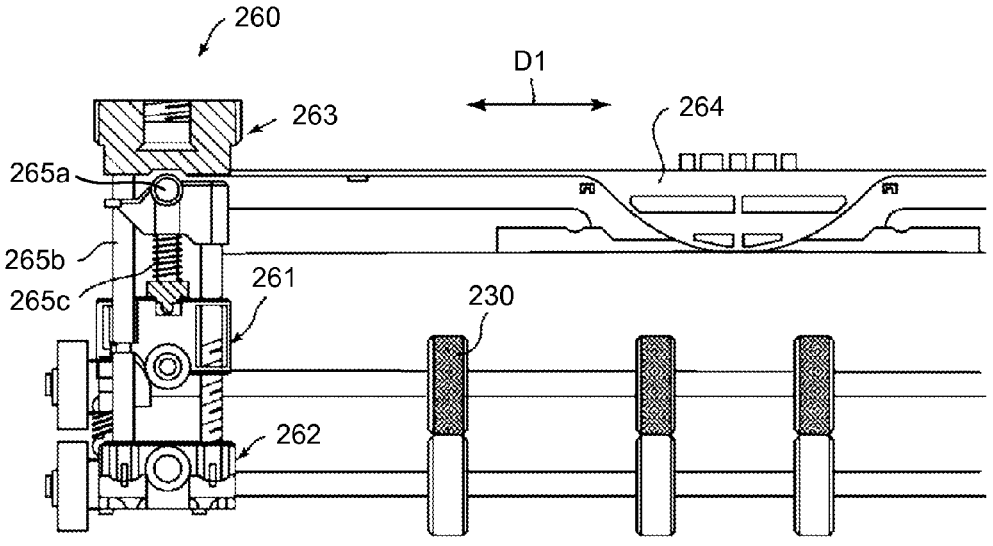
FIG. 8 is a side view illustrating a principal part of FIG. 7 seen from a left side.

FIG. 7 is a set of front views illustrating a principal part of the additional folding roller unit 260 and the folding roller pair 230, and FIG. 8 is a side view illustrating a principal part of FIG. 7 seen from a left side.

As illustrated in FIG. 6, the additional folding roller unit 260 is installed at the paper discharge conveyance path 244 positioned between the folding roller pair 230 and the lower paper discharge roller 231. The additional folding roller unit 260 includes a unit moving mechanism 263, a guiding member 264, and a pressing mechanism 265. The unit moving mechanism 263 moves the additional folding unit 260 back and forth along the guiding member 264 in a depth direction in the figure (a direction orthogonal to the sheet conveyance direction). The unit moving mechanism 263 includes a driving source and a drive mechanism that are not illustrated but provided to move the additional folding roller unit 206. The pressing mechanism 265 presses the sheet bundle SB by applying pressure thereto in the vertical direction and includes, in order to perform this action, an additional folding roller/upper unit 261 and an additional folding roller/lower unit 262.

The additional folding roller/upper unit 261 is supported by a support member 265*b* to be able to move in the vertical direction with respect to the unit moving mechanism 263. That is, the additional folding roller/lower unit 262 is immovably attached to the lower end of the support member 265*b* of the pressing mechanism 265. An upper additional folding roller 261*a* of the additional folding roller/upper unit 261 can be pressed against a lower additional folding roller 262*a*. As a result, the sheet bundle SB can be pressurized when nipped between the nips of the both rollers. The pressurizing force used to pressurize the sheet bundle SB is given by a pressurizing spring 265*c*, the elastic force of which applies pressure to the additional folding roller/upper unit 261. While in the pressurizing state, the additional folding roller moves in a width direction (a direction indicated by an arrowed line D1 in FIG. 8) of the sheet bundle SB and performs additional folding of the fold portion SB1 as will be described later.

Figure 9:
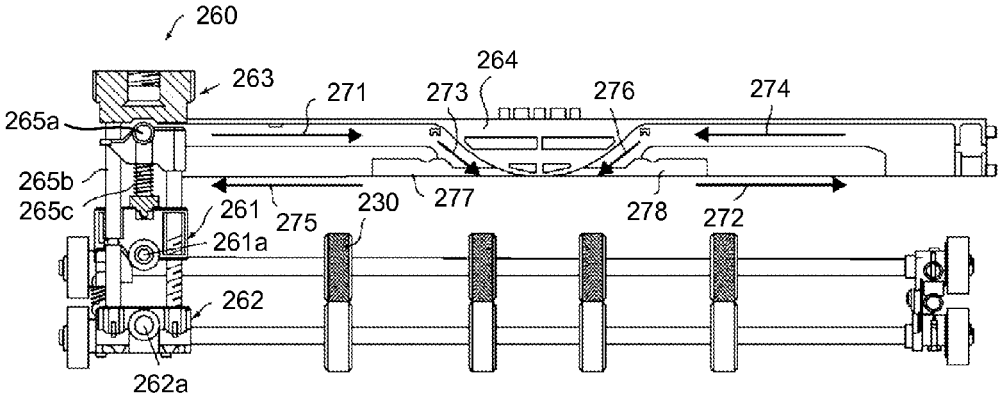
FIG. 9 is a diagram illustrating a guiding member in detail.

FIG. 9 is a diagram illustrating the guiding member 264 in detail. The guiding member 264 includes a guide path 270 which guides the additional folding roller unit 260 in the width direction of the sheet bundle SB, where six paths are set in the guide path 270 including:

1) a first guide path 271 which guides the pressing mechanism 265 in a non-pressed state at the time of forward movement;

2) a second guide path 272 which guides the pressing mechanism 265 in a pressed state at the time of forward movement;

3) a third guide path 273 which switches a pressing mechanism 265 from the non-pressed state to the pressed state at the time of forward movement;

4) a fourth guide path 274 which guides the pressing mechanism 265 in the non-pressed state at the time of backward movement;

5) a fifth guide path 275 which guides the pressing mechanism 265 in the pressed state at the time of backward movement; and 6) a sixth guide path 276 which switches the pressing mechanism 265 from the non-pressed state to the pressed state at the time of backward movement.

Figure 10:
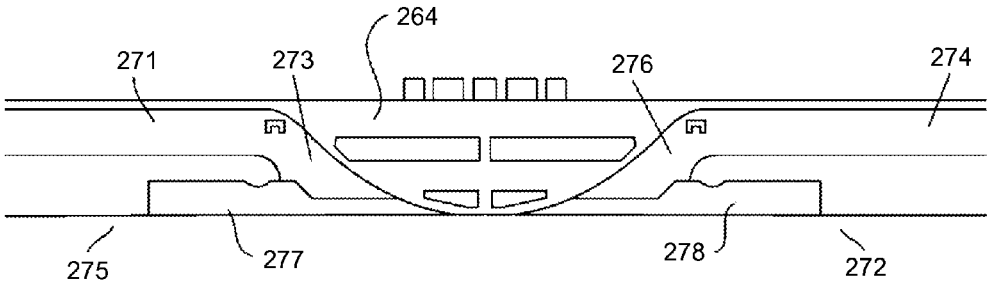
FIG. 10 is an enlarged view illustrating a principal part of FIG. 9 where a path switching claw is not switched.
Figure 11:
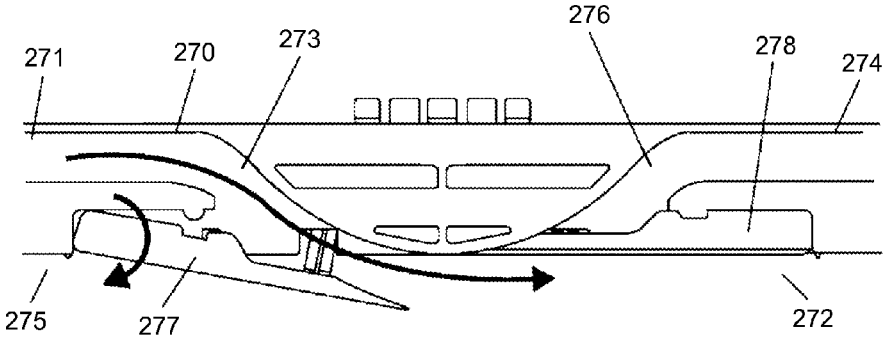
FIG. 11 is an enlarged view illustrating the principal part of FIG. 9 where a first path switching claw is switched.

FIGS. 10 and 11 are enlarged views illustrating the principal part of FIG. 9. As illustrated in FIGS. 10 and 11, a first path switching claw 277 and a second path switching claw 278 are installed at an intersection between the third guide path 273 and the second guide path 272 and at an intersection between the sixth guide path 276 and the fifth guide path 275, respectively. As illustrated in FIG. 11, the first path switching claw 277 can switch a path from the third guide path 273 to the second guide path 272, while the second path switching claw 278 can switch a path from the sixth guide path 276 to the fifth guide path 275. The former however cannot switch a path from the second guide path 272 to the third guide path 273, and the latter cannot switch a path from the fifth guide path 275 to the sixth guide path 276. In other words, the path switching claws are configured to not be able to switch a path in a reverse direction. Note that an arrowed line illustrated in FIG. 11 indicates a locus of movement of a guide pin 265*a* included in the pressing mechanism 265 (see FIGS. 7, 23(B) and 24).

The pressing mechanism 265 can move along the guide path 270 because the guide pin 265*a* of the pressing mechanism 265 is movably engaged within the guide path 270 in loose engagement. That is, the guide path 270 functions as a cam groove, and the guide pin 265*a* functions as a cam follower that shifts while moving along the cam groove.

FIGS. 12 to 22 are diagrams illustrating the additional folding operation performed by the additional folding roller unit of the present embodiment.

Figure 12:
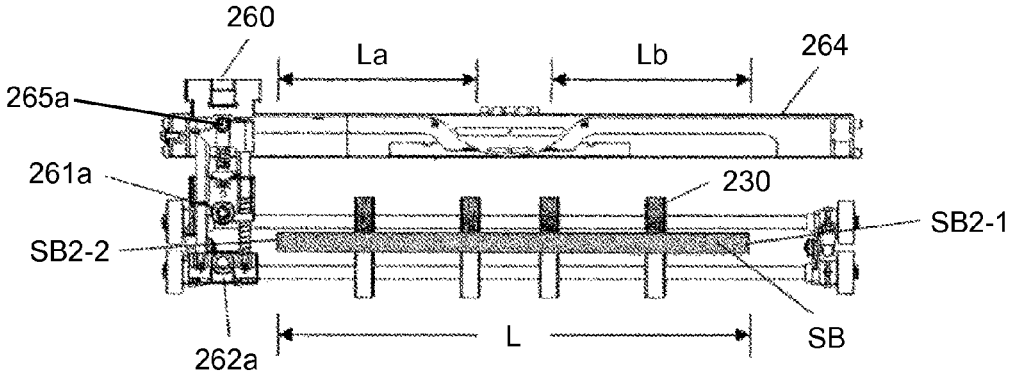
FIG. 12 is a diagram illustrating an initial state of an additional folding operation.

FIG. 12 illustrates a state where the sheet bundle SB folded by the folding roller pair 230 is conveyed and stopped at a preset additional folding position while the additional folding roller unit 260 is at a standby position. This is the initial position of the additional folding operation.

Figure 13:
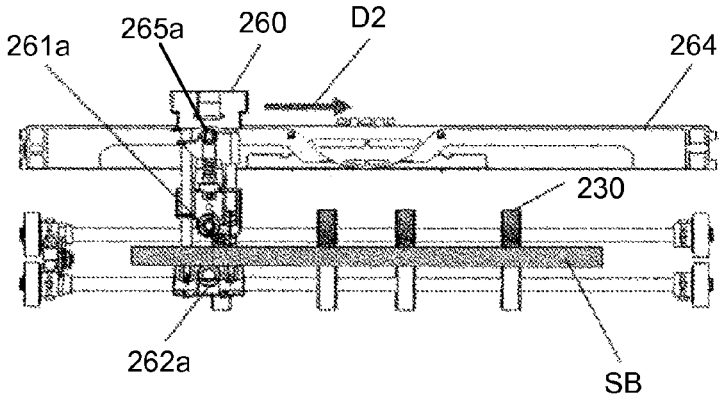
FIG. 13 is a diagram illustrating a state where an additional folding roller unit starts a forward movement.
Figure 14:
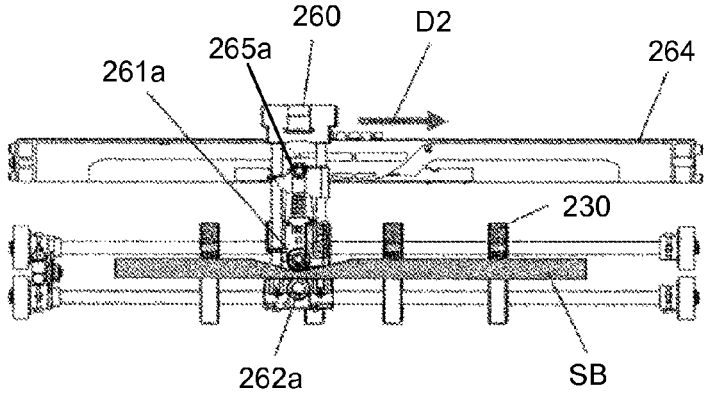
FIG. 14 is a diagram illustrating a state where the additional folding roller unit comes to a third guide path in the vicinity of a center of the sheet bundle.

The additional folding roller unit 260 starts the forward movement from the initial position (FIG. 12) into a right direction as illustrated in the figure (a direction indicated by an arrowed line D2) (FIG. 13). Here, the pressing mechanism 265 in the additional folding roller unit 260 moves along the guide path 270 of the guiding member 264 by the action of the guide pin 265*a*. The additional folding roller unit moves along the first guide path 271 right after the operation is started. The pair of additional folding rollers 261*a* and 262*a* is in the non-pressed state at this time. Here, the non-pressed state represents a state where the additional folding rollers 261*a* and 262*a* are in contact with the sheet bundle SB but hardly applying pressure thereto, or a state where the additional folding rollers 261*a* and 262*a* are separated from the sheet bundle SB.

Figure 15:
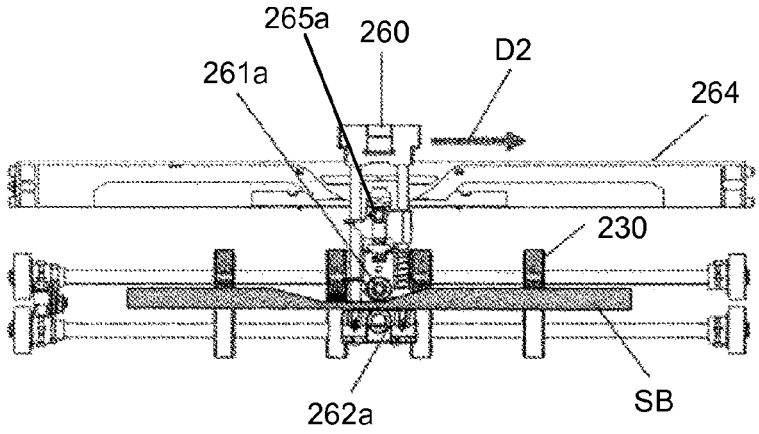
FIG. 15 is a diagram illustrating a state where the additional folding roller unit pushes aside the first path switching claw and enters a second guide path.

Having come to the third guide path 273 near the center of the sheet bundle SB (FIG. 14), the pressing mechanism 265 starts descending along the third guide path 273 and enters the second guide path 272 by pushing aside the first path switching claw 277 (FIG. 15). The pressing mechanism 265 here presses the additional folding roller/upper unit 261 so that the additional folding roller/upper unit 261 abuts on the sheet bundle SB and is in the pressed state therewith.

Figure 16:
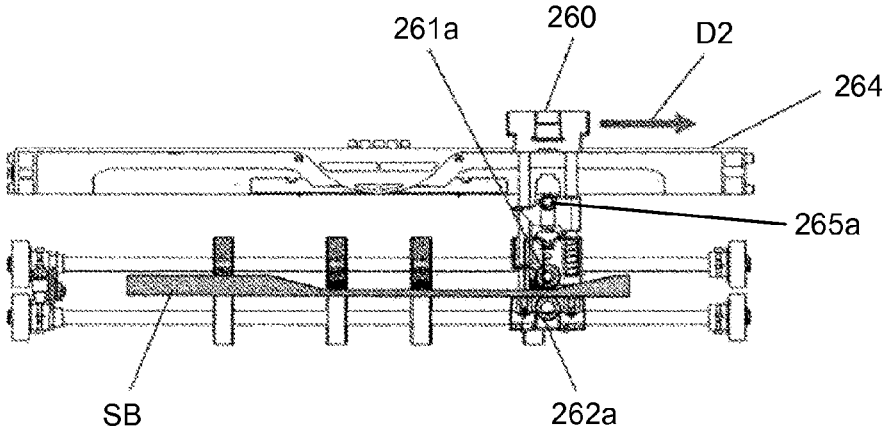
FIG. 16 is a diagram illustrating a state where the additional folding roller unit moves into an edge direction while pressing the sheet bundle.
Figure 17:
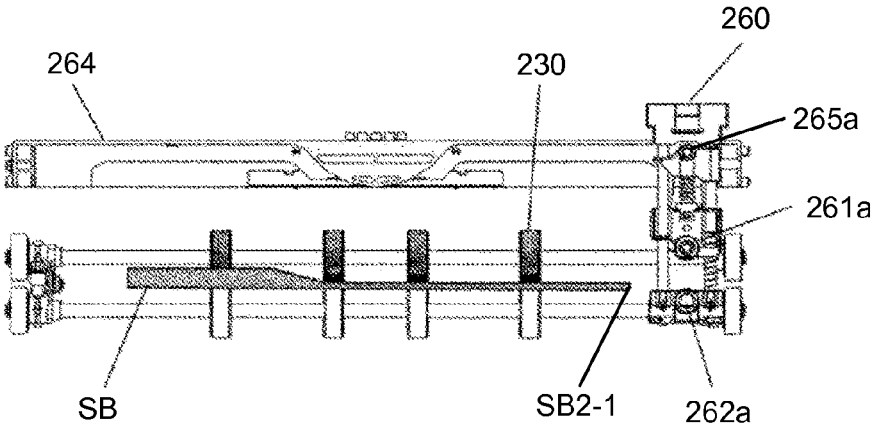
FIG. 17 is a diagram illustrating a state where the additional folding roller unit has moved to a final position of the forward movement along the second guide path.

The additional folding roller unit 260 further moves in the direction indicated by the arrowed line D2 while keeping the pressed state (FIG. 16). At this time, the additional roller unit moves along the second guide path 272 without being guided by the sixth guide path 276 because the second path switching claw 278 cannot move in the reverse direction, passes through the sheet bundle SB, and is positioned at the final position of the forward movement (FIG. 17). Having moved to this point, the guide pin 265*a* of the pressing mechanism 265 now shifts from the second guide path 272 to the fourth guide path 274 thereabove. As a result, the position of the guide pin 265*a* is not controlled by the upper surface of the second guide path 272 anymore, whereby the upper additional folding roller 261*a* is separated from the lower additional folding roller 262*a* to be in the non-pressed state.

Figure 18:
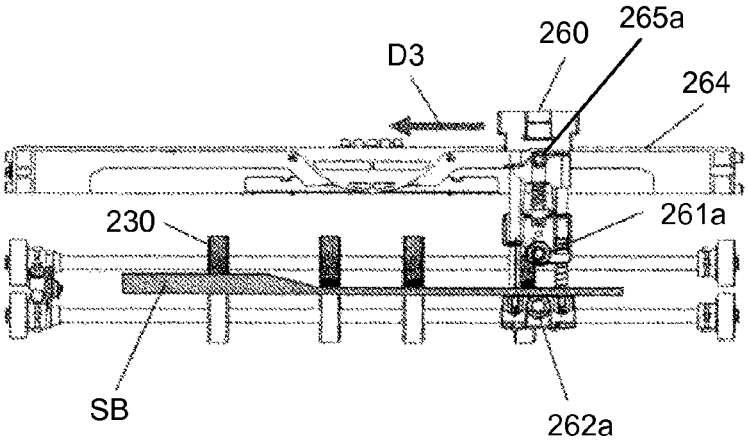
FIG. 18 is a diagram illustrating a state where the additional folding roller unit starts a backward movement from the final position of the forward movement.
Figure 19:
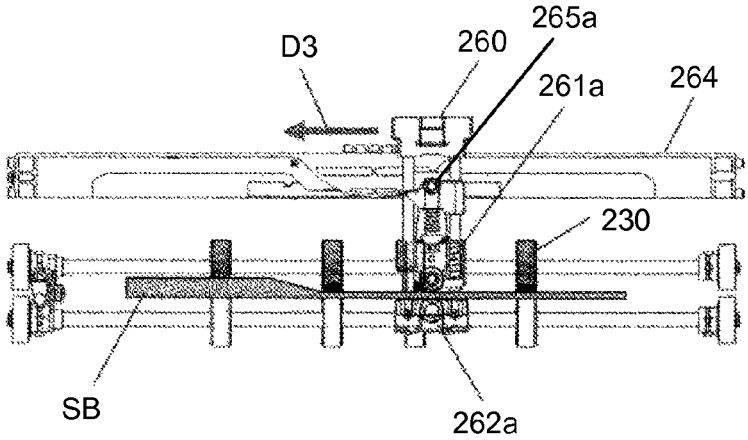
FIG. 19 is a diagram illustrating a state where the additional folding roller unit comes to a sixth guide path after starting the backward movement.
Figure 20:
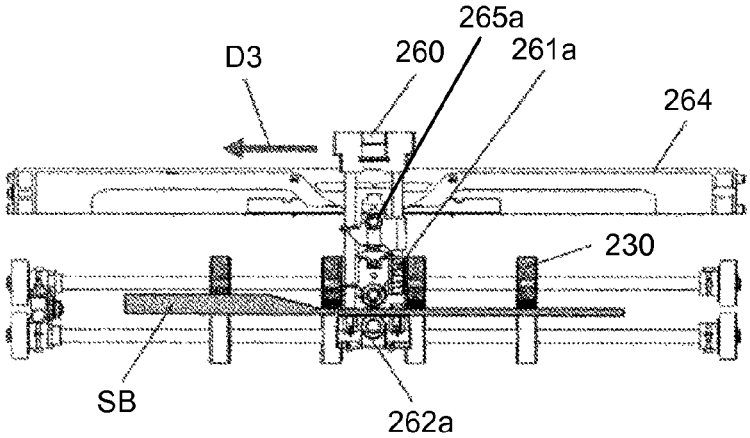
FIG. 20 is a diagram illustrating a state where the additional folding roller unit having come to the sixth guide path shifts from a non-pressed state to a pressed state.
Figure 21:
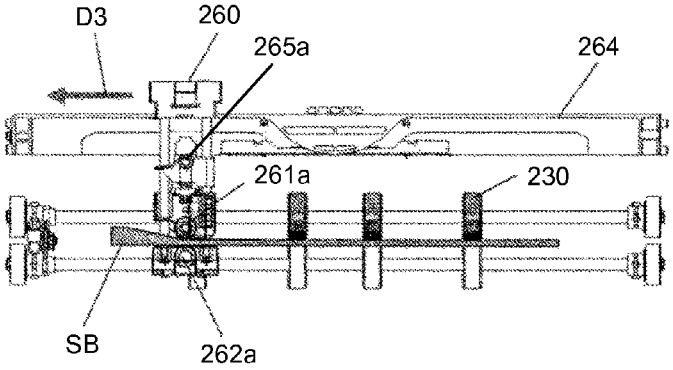
FIG. 21 is a diagram illustrating a state where the additional folding roller unit is completely in the pressed state when having entered a fifth guide path.

Next, the additional folding roller unit 260 starts the backward movement by the unit moving mechanism 263 (FIG. 18). In the backward movement, the pressing mechanism 265 moves to the left as illustrated in the figure (a direction indicated by an arrowed line D3) along the fourth guide path 274. When the pressing mechanism 265 moves and comes to the sixth guide path 276 (FIG. 19), the guide pin 265*a* is pushed downward along the shape of the sixth guide path 276 so that the pressing mechanism 265 shifts from the non-pressed state to the pressed state (FIG. 20).

Figure 22:
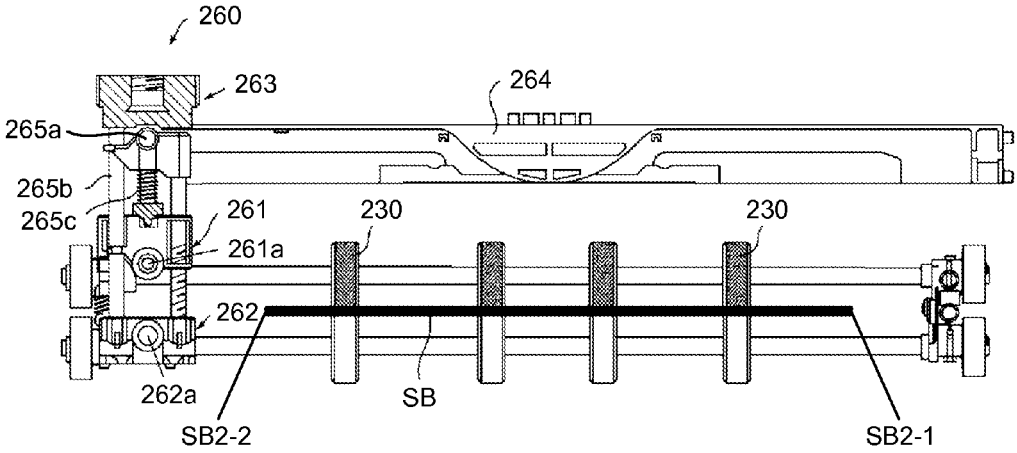
FIG. 22 is a diagram illustrating a state where the additional folding roller unit returns to an initial position after moving through the fifth guide path.

The pressing mechanism is in the completely pressed state once entering the fifth guide path 275, moves through the fifth guide path 275 in the direction indicated by the arrowed line D3 (FIG. 21), and then passes through the sheet bundle SB (FIG. 22).

The additional folding is applied to the sheet bundle SB by moving the additional folding roller unit 260 back and forth, as described above. At this time, the additional folding roller unit starts the additional folding of the sheet bundle SB from the center part thereof toward one side, and passes through one edge SB2-1 of the sheet bundle SB (FIG. 17). Subsequently, the additional folding roller unit starts the additional folding of the sheet bundle from the center part thereof toward another side by passing above the additionally-folded sheet bundle SB, and passes through another edge SB2-2 (FIG. 22).

Operated in the aforementioned manner, the pair of additional folding rollers 261*a* and 262*a* do not contact or pressurize the edge SB2-1 of the sheet bundle SB from outside thereof when starting the additional folding or returning to the other edge SB2-2 of the sheet bundle SB after passing through the one edge SB2-1. In other words, there is no damage to the edge SB2-1 of the sheet bundle SB when the additional folding roller unit passes through the edge SB2-1 of the sheet bundle SB from outside thereof because the additional folding roller unit 260 is in the non-pressed state. It is also less likely that a kink causing a crease or the like builds up because the additional folding is performed from near the center part of the sheet bundle SB toward the edge SB2-1 and the edge SB2-2 respectively, allowing the distance traveled by the additional folding roller unit in contact with the sheet bundle SB to be decreased at the time of the additional folding. As a result, there is no damage done to the edges SB2-1 and 2-2 of the sheet bundle SB in performing the additional folding at the folding line portion (back) SB1 of the sheet bundle SB, thereby also suppressing a turn-up or a crease at the folding line portion SB1 or in the vicinity thereof caused by the kink buildup.

The following condition is used in order for the pair of additional folding rollers 261*a* and 262*a* to not run onto the edge SB2-1 of the sheet bundle SB from outside the edge SB2-1. Letting "La" be a distance for which the additional folding roller unit 260 moves on the sheet bundle in the non-pressed state at the time of the forward movement, and "Lb" be a distance for which the additional folding roller unit moves on the sheet bundle in the non-pressed state at the time of the backward movement, as illustrated in the operation in FIGS. 12 to 22, it is required that the relationship between a length L of the sheet bundle in the width direction thereof and the distances La and Lb satisfy the following (FIGS. 12 to 14 and FIGS. 17 to 19).

$$L>La+Lb$$

Moreover, it is desired that the pressing be started near the center part of the sheet bundle SB in the width direction thereof by setting the distances La and Lb roughly the same (FIGS. 16 and 20).

Note that while the additional folding roller unit 260 of the present embodiment performs the additional folding by the pair of additional folding rollers 261*a* and 262*a* with the provision of the additional folding roller/lower unit 262, another method may be employed. For example, the additional folding roller/lower unit 262 may be eliminated while providing the additional folding roller/upper unit 261 and a receiving member (not illustrated) having an abutment surface facing the additional folding roller/upper unit so that the sheet bundle is pressed between the two.

Furthermore, the additional folding roller unit 260 of the present embodiment includes the additional folding roller/upper unit 261 that is configured to be able to move vertically and the additional folding roller/lower unit 262 that is configured not to move vertically. This configuration can however be replaced by the following.

That is, the additional folding roller/lower unit 262 can be configured to be able to move vertically as well. Such configuration allows the additional folding position to be fixed regardless of the thickness of the sheet bundle SB and further allows damage such as a flaw to be suppressed because the upper and lower additional folding rollers 261*a* and 262*a* move toward and away from each other in a symmetrical manner with respect to the additional folding position.

A characteristic of the sheet processing apparatus including the aforementioned configuration will be described. Note that in FIG. 23, a member identical to that in FIG. 7 will be indicated with a reference numeral identical to that assigned to the identical member in FIG. 7.

The characteristic of the sheet processing apparatus according to the present embodiment is that the shaft line direction of the additional folding roller included in the additional folding roller unit 260 can be tilted at the time of pressurization, the additional folding roller unit being a pressing member as a pressing unit used in the additional folding process.

This means that, when in contact with the back of the sheet bundle SB at the time of pressurizing, the additional folding roller can exert pressure while positioning the additional folding roller corresponding to the downstream side of the back of the sheet bundle in the conveyance direction to the lower side in the shaft direction corresponding to the longitudinal direction of the additional folding roller.

FIGS. 23(A) to 23(D) are diagrams illustrating a configuration and working of the aforementioned characteristic.

The additional folding roller/upper unit 261 used in the additional folding roller unit 260 rotatably supports the additional folding roller 261*a*, the shaft direction of which corresponds to the longitudinal direction indicated by a reference numeral L and is parallel to the conveyance direction of the sheet bundle SB (a direction indicated by an arrowed line F in FIG. 23(A)).

The additional folding roller 261*a* is configured to pressurize the sheet bundle SB by a load applied to the roller from a pressurizing spring 265*c* included in the additional folding roller/upper unit 261.

A plurality of pressurizing springs 265*c* (indicated by reference numerals 265*c*1, 265*c*2, and 265*c*3) is provided in the present embodiment.

An edge of each pressurizing spring, from which the load, is provided at a position to exert the pressurizing force on the downstream side of the back (a position indicated by a reference numeral BF in FIG. 23(C)) of the sheet bundle SB in the conveyance direction, in the shaft direction of the additional folding roller 261*a*.

Figure 23:
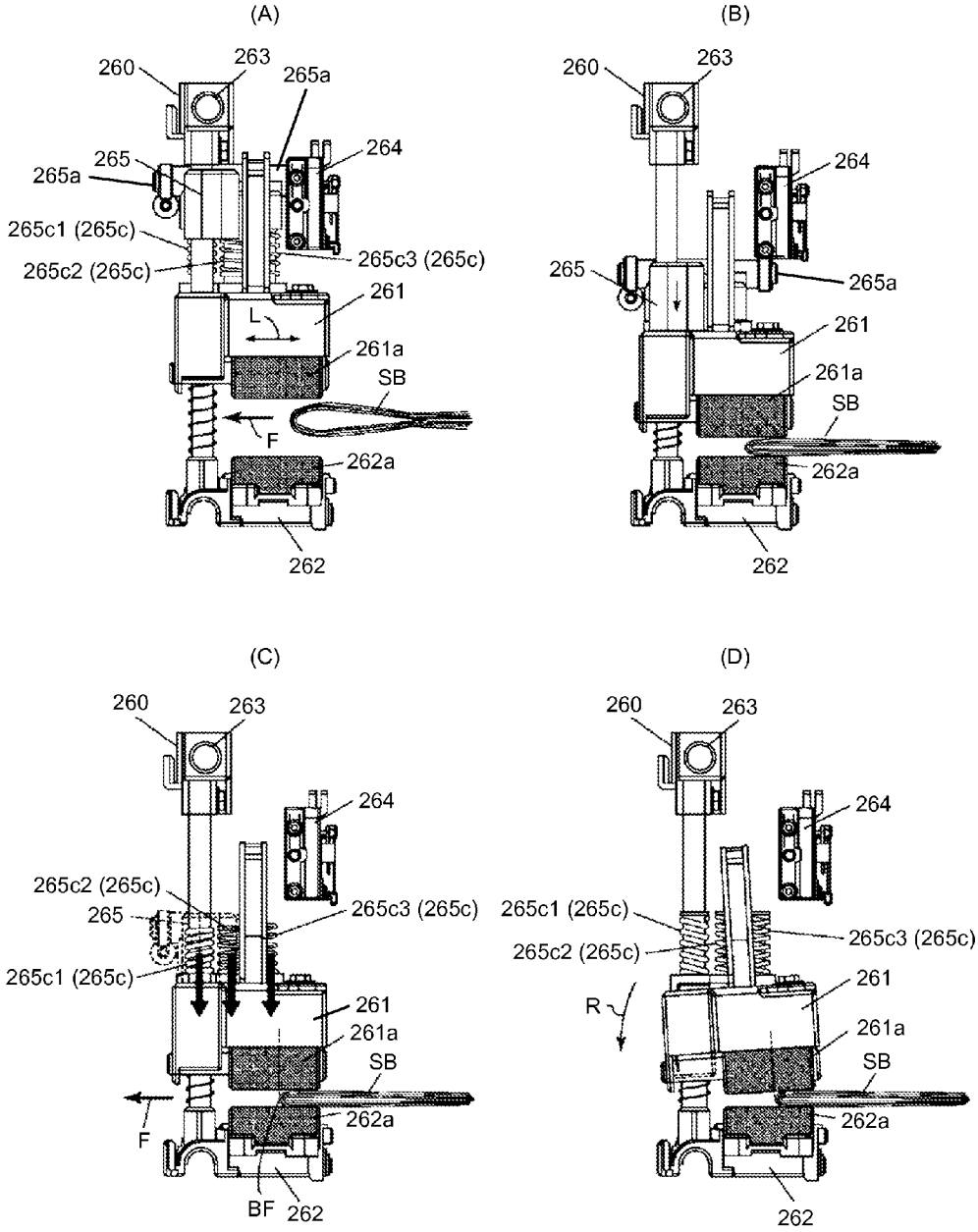
FIGS. 23(A) to 23(D) are diagrams each illustrating a characteristic of the sheet processing apparatus according to an embodiment of the present invention to be applied to the configuration illustrated in FIG. 1 to FIG. 22.

Accordingly, as illustrated in FIG. 23(D), the additional folding roller 261*a* at the time of pressurizing the sheet bundle SB can be tilted to a position where a region of the roller on the downstream side of the nip in the conveyance direction comes below the nip at the time of pressurization, the nip pressurizing the sheet bundle SB in the shaft direction. An arrowed line R illustrated in FIG. 23(*d*) indicates a direction into which the downstream side of the additional folding roller 261*a* in the conveyance direction is tilted with respect to the shaft direction of the roller.

While the configuration of the present embodiment has been described above, the working of the present embodiment will be described as follows with reference to FIGS. 23(A) to 23(D).

FIG. 23(A) illustrates a state where the sheet bundle SB is conveyed from a folding roller not illustrated to the additional folding position along a conveyance direction F.

The back (BF) of the sheet bundle SB in this state is positioned and nipped on the upstream side of a range in the conveyance direction, the range being occupied by the pressurizing spring 265*c* in the shaft direction of the additional folding roller 261*a*.

FIG. 23(B) illustrates a state where the sheet bundle SB is pressurized by the pressing mechanism 265 between the additional folding roller/upper unit 261 and the additional folding roller 262*a* on the side of the additional folding roller/lower unit 262 facing the additional folding roller 261*a* of the additional folding roller/upper unit 261.

The additional folding roller/upper unit 261 in this state is pressed by the pressing mechanism and descends toward the sheet bundle SB. As the additional folding roller/upper unit 261 keeps descending, the additional folding roller 261*a* is brought into contact with the sheet bundle SB and starts the additional folding while applying pressure.

At the start of the additional folding, as illustrated in FIG. 23C, the load applied by the plurality of pressurizing springs 265*c*1 to 265*c*3 to the additional folding roller/upper unit 261 reaches the downstream side of the conveyance direction beyond the position of the back BF, in the conveyance direction of the sheet bundle SB. Therefore, the additional folding roller 261*a* corresponding to the downstream side of the conveyance direction can be tilted downward while having the nip that is in contact with the sheet bundle SB in the shaft direction as a fulcrum.

The arrowed line R illustrated in FIG. 23(D) indicates the direction into which the additional folding roller/upper unit 261 supporting the additional folding roller 261*a* is tilted from the state before coming into contact with the sheet bundle, and also indicates that the state of the additional folding roller 261*a* is changed from a state before the roller is in contact with the sheet bundle SB.

Accordingly, the edge of the additional folding roller 261*a* in the shaft direction is lifted from the nip portion positioned on the upstream side of the conveyance direction of the sheet bundle SB, whereby the edge of the roller does not pressurize the nip portion. As a result, there can be prevented the pressurized mark caused when the edge of the roller pressurizes the nip portion unintentionally and carelessly due to the dimensional variation or rigidity of a component of the additional folding mechanism.

A variation of the principal part illustrated in FIG. 23 will now be described.

Figure 24:
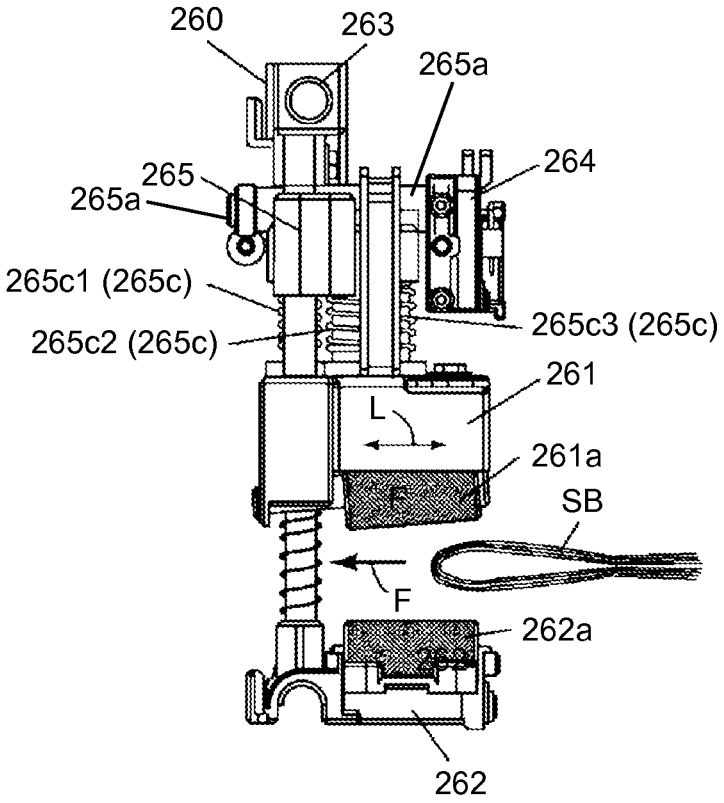
FIG. 24 is a diagram illustrating a variation of the configuration illustrated in FIGS. 23(A) to 23(D).

FIG. 24 illustrates a configuration, as the variation, where the shaft direction of the additional folding roller 261*a* is tilted beforehand such that the downstream side of the roller in the conveyance direction of the sheet bundle SB is positioned on the lower side.

Letting "d1" be a gap between the nips at the position of the back BF corresponding to the fold position of the sheet bundle SB and "d2" be a gap between the nips on the downstream side of the conveyance direction, a relationship d1>d2 is determined in this case.

As a result, the downstream side of the additional folding roller 261*a* in the conveyance direction is tilted downward.

In the configuration illustrated in FIGS. 23 and 24 as described above, the load applied to the sheet bundle SB is distributed as follows by the positioning of the pressurizing spring 265.

That is, the load distribution is more intense on the downstream side of the conveyance direction than at the nip portion on the upstream side of the conveyance direction when the position of the back BF of the sheet bundle SB corresponding to the fold position is provided as a reference.

This can almost surely avoid the case where the upstream side of the additional folding roller 261*a* in the conveyance direction comes into contact with the nip portion of the sheet bundle SB, thereby eliminating the chance of leaving the pressurized mark generated when the sheet bundle SB is pressurized by the edge of the roller on the upstream side of the conveyance direction.

According to the present invention, the impact of pressurization by a pressing member is reduced on an upstream side of a conveyance direction due to the configuration where the pressing member pressurizes while a downstream side of the conveyance direction is positioned on the lower side relative to the fold position in the conveyance direction of the sheet bundle. As a result, there can be prevented a case where the pressurized mark is unintentionally and carelessly left in the sheet bundle on the upstream side of the conveyance direction when the pressurized state of the pressing member with respect to the fold position is changed by a mechanical error of a member used in the additional folding mechanism.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus, comprising:

a pressing roller configured to press a folding line portion of a folded sheet bundle in a direction of a thickness of the folded sheet bundle;

an elastic member positioned downstream in relation to the pressing roller so as to press a part of the pressing roller corresponding to a downstream side of a conveyance direction of the sheet bundle; and a moving unit configured to move the pressing member to a folding line direction of the sheet bundle.

2. The sheet processing apparatus according to claim 1, wherein the part of the sheet bundle corresponding to the downstream side of the conveyance direction corresponds to a part of the sheet bundle positioned at a downstream side of the conveyance direction beyond a position of a back of the sheet bundle folded back along a position of the folding line portion.

3. The sheet processing apparatus according to claim 1, wherein the pressing roller applies a load at the position of the folding line portion of the sheet bundle.

4. The sheet processing apparatus according to claim 1, wherein a distribution of the load applied by the pressing roller is determined to be more intense in the part corresponding to the downstream side of the conveyance direction beyond the position of the folding line portion than in a nipped part not beyond the position of the folding line portion.

5. The sheet processing apparatus according to claim 1, wherein the pressing roller includes a roller having a shaft line being located in the conveyance direction of the sheet bundle, and the roller is configured to be able to change, when the roller comes into contact with the sheet bundle to pressurize the sheet bundle, tilt of the shaft line of the roller so that a portion of the roller corresponding to the downstream side of the conveyance direction is shifted to contact with a portion of the sheet bundle corresponding to the downstream side of the conveyance direction.

6. The sheet processing apparatus according to claim 5 wherein, where d1 represents a gap of a nip of the roller at the position of the folding line portion and d2 represents a gap of the nip on the downstream side of the conveyance direction, the roller has a tilt with which the nip at the position of the folding line portion of the sheet bundle acquires a relationship d1>d2.

7. An image processing system comprising an image forming apparatus and a sheet processing apparatus that saddle-stitches a sheet bundle and center-folds the sheet bundle, wherein the image forming apparatus is used as a preceding apparatus and the sheet processing apparatus is used as a following apparatus, and the image forming apparatus is connected to the sheet processing apparatus at a boundary corresponding to a position at which the sheet bundle is subjected to saddle stitching and center folding; and the sheet processing apparatus includes:

a pressing roller configured to press a folding line portion of a folded sheet bundle in a direction of a thickness of the folded sheet bundle;

an elastic member positioned downstream in relation to the pressing roller so as to press a part of the pressing roller corresponding to a downstream side of a conveyance direction of the sheet bundle; and a moving unit configured to move the pressing member to a folding line direction of the sheet bundle.

8. The sheet processing apparatus according to claim 1, wherein the moving unit moves the pressing roller back and forth along a guiding member, and the pressure is controlled via the movement of the pressure roller on the guiding member.

9. The sheet processing apparatus according to claim 1, wherein the guiding member includes a guide path which guides the moving unit in a width direction of the sheet bundle.

10. The sheet processing apparatus according to claim 9, further comprising a plurality of pressing members, wherein the guide path includes:

a first guide path which guides the pressing members in a non-pressed state at the time of forward movement;

a second guide path which guides the pressing members in a pressed state at the time of forward movement;

a third guide path which switches the pressing members from the non-pressed state to the pressed state at the time of forward movement;

a fourth guide path which guides the pressing members in the non-pressed state at the time of backward movement;

a fifth guide path which guides the pressing members in the pressed state at the time of backward movement; and a sixth guide path which switches the pressing members from the non-pressed state to the pressed state at the time of backward movement.

11. The sheet processing apparatus according to claim 10, further comprising a first path switching claw and a second path switching claw.

12. The sheet processing apparatus according to claim 11, wherein the first path switching claw and the second path switching claw are installed at an intersection between the third guide path and the second guide path and at an intersection between the sixth guide path and the fifth guide path, respectively.

13. The sheet processing apparatus according to claim 11, wherein the first path switching claw can switch a path from the third guide path to the second guide path, while the second path switching claw can switch a path from the sixth guide path to the fifth guide path.

14. The sheet processing apparatus according to claim 9, wherein the guiding member slopes at a center thereof in a direction orthogonal to the conveyance direction of the sheet bundle.

15. The sheet processing apparatus according to claim 9, further comprising a guide pin, wherein the pressing members move along the guide path of the guiding member by an action of the guide pin.

* * * * *